US007044338B2

(12) United States Patent
Roden

(10) Patent No.: US 7,044,338 B2
(45) Date of Patent: May 16, 2006

(54) AEROSOL PRODUCT DISPENSER SYSTEM

(76) Inventor: William C. Roden, 51582 Highway 112, Port Angeles, Clallam County, WA (US) 98363

( * ) Notice: Subject to any disclaimer, the term of this patent is extended or adjusted under 35 U.S.C. 154(b) by 0 days.

(21) Appl. No.: 11/051,851

(22) Filed: Feb. 4, 2005

(65) Prior Publication Data

US 2005/0173465 A1 Aug. 11, 2005

Related U.S. Application Data

(60) Provisional application No. 60/543,193, filed on Feb. 10, 2004.

(51) Int. Cl.
*B67D 5/32* (2006.01)

(52) U.S. Cl. ..... 222/153.11; 222/291; 222/402.1; 222/538

(58) Field of Classification Search ..... 222/153.11, 222/291, 402.1, 538, 564, 566, 635
See application file for complete search history.

(56) References Cited

U.S. PATENT DOCUMENTS

| | | | | |
|---|---|---|---|---|
| 2,731,298 | A | | 1/1956 | Green |
| 2,968,441 | A | * | 1/1961 | Holcomb ..... 239/337 |
| 3,191,809 | A | | 6/1965 | Schultz et al. |
| 3,209,960 | A | | 10/1965 | Green |
| 3,216,628 | A | | 11/1965 | Fergusson |
| 3,424,354 | A | | 1/1969 | Dykinga |
| 3,804,296 | A | | 4/1974 | Webster |
| 3,913,842 | A | | 10/1975 | Singer |
| 4,440,325 | A | | 4/1984 | Treuhaft et al. |
| 4,758,158 | A | | 7/1988 | Pierce et al. |
| 4,775,081 | A | | 10/1988 | Morane |
| 4,811,871 | A | | 3/1989 | Wass et al. |
| 4,944,458 | A | | 7/1990 | Sassenberg |
| 4,978,035 | A | | 12/1990 | Morane |
| 4,978,036 | A | | 12/1990 | Burd |

(Continued)

OTHER PUBLICATIONS

Computronics Corp. technical data sheets from web site Mar. 2003.

(Continued)

*Primary Examiner*—Joseph A. Kaufman
(74) *Attorney, Agent, or Firm*—Innovation Law Group, Ltd.; Jacques M. Dulin, Esq.

(57) ABSTRACT

A multi-element spray delivery system for targeted delivery of product from aerosol spray cans comprising an aerosol can button having a short connector tube connecting to a removable extension tube. The system optionally includes a spray discharge limiter, and a sealing tip cap that fits over either the button connector tube or the extension tube. The selective combined use of these components permits targeted delivery of aerosolized product, including lubricants, paint, personal care products, food products, insulation and caulks, herbicides, insecticides or compressed air for more efficient and effective delivery as and where needed with reduction in waste and overspray. An extension tube keeper system is included for convenient storage of the extension tube on the can after use. The component system is also provided in a kit form either by the OEM producer of the aerosol product along with the new can, or as an after-market product.

13 Claims, 5 Drawing Sheets

U.S. PATENT DOCUMENTS

| | | | | |
|---|---|---|---|---|
| 4,978,038 | A | 12/1990 | Sullivan | |
| 5,060,823 | A * | 10/1991 | Perlman | 222/1 |
| D324,824 | S | 3/1992 | Hansen | |
| 5,183,184 | A | 2/1993 | Ranalletta et al. | |
| 5,282,551 | A * | 2/1994 | Pierson | 222/153.11 |
| 5,772,084 | A * | 6/1998 | Yale et al. | 222/402.1 |
| 5,988,575 | A | 11/1999 | Lesko | |
| 6,390,339 | B1 | 5/2002 | Lee | |
| 6,783,037 | B1 * | 8/2004 | Bonham | 222/570 |
| 2002/0023933 | A1 | 2/2002 | Wrigley | |
| 2002/0084289 | A1 * | 7/2002 | Stern et al. | 222/402.1 |
| 2003/0066846 | A1 | 4/2003 | DiMelgio | |
| 2004/0099696 | A1 * | 5/2004 | Stratemeier et al. | 222/402.1 |

OTHER PUBLICATIONS

Precision Valve Canada, Specs for Snap Fit Pump Sprayers from web site Mar. 2003.

* cited by examiner

AEROSOL PRODUCT DISPENSER SYSTEM

This application claims benefit to provisional application Ser. No. 60/543,193, filed Feb. 10, 2004.

FIELD

The invention relates to improvements in product dispenser systems for aerosol cans, and more particularly to a multi-element system comprising both short and long, extension tubes, caps, buttons and retainers for the extension tubes that permit selectively targeted delivery of the product contents of aerosol cans for more efficient and effective delivery as and where needed with reduction in waste and overspray.

BACKGROUND

Aerosol cans are extensively used for a wide variety of products, ranging from lubricants, paint, personal care products, food products, insulation and caulks, herbicides and insecticides to plain compressed air for cleaning. Over 10 billion cans are produced annually in the US alone.

One of the smallest, but critical components for dispensing the products in a spray configuration (as distinct from a stream as in the case of insulation materials) is the "button". The button is the small cylindrical plastic element on the top of the can that is pressed by the finger to actuate dispensing of the product contents of the can. This button typically contains intersecting channels terminating in an exterior aperture of engineered design and dimensions that comprises the "valve" which forms the spray pattern and droplet size.

Button valves for wide area coverage, such with paints, form a distinctive pattern, and the user must develop skill to lay down the materials evenly and without drips. These wide area pattern sprays also create extensive overspray that wastes product and contaminates the environment, as well as posing a health hazard for many products, such as insecticides and herbicides.

Some aerosolized products require delivery into remote recesses. Current methods of dispensing such products employ a button, the valve orifice of which is recessed to allow for insertion of a long extender tube so that the point of discharge is on the order of 6" away from the button. Typically these extender tubes are very difficult to insert, often requiring substantial force and precise alignment, akin to threading a needle. In addition there are no effective methods of storing the extender tube after use. U.S. Pat. No. 5,772,084 of Yale and patent Publication 2003/0066846 A1 of DiMeglio propose functional storage solutions, but are neither practical to use or produce. More recently, the maker of the popular lubricant WD-40, after 40 years of offering its product with an extender tube, now offers a special cap with a little horizontal groove on the top into which the "straw", as the extender tube is called, can be snapped to retain it after use. However, this makes the can effectively 6" wide and not convenient for post-use storage. That is, since the straw extends several inches on both sides of the can, it can easily be knocked-off and lost when bumped by adjacent cans or the walls of a storage cabinet, box or tool chest. Loosing the straw reduces the product to uselessness, as the wide area nozzle pattern cannot be used to deliver lubricant precisely where it is needed in controlled amounts. Thus, the "new" WD-40 solution is no solution. Rather, it merely substitutes a new and different problem for the old one.

An additional problem is that the current button valves must be actuated vertically (they are pressed downwardly to release product) and mounted on stiff valve actuator springs. This means that proportional control of the rate of dispensing is not possible. The result is that the user usually tries to control the amount of product dispense by a time duration method, a "just a quick squirt" approach. It is universally recognized that this approach rarely works, is not reproducible, and is very difficult to achieve, resulting in overspray or under-spray, not exact spray.

Accordingly there is a need in the art for an aerosol can product delivery system that improves the efficiency of dispensing the contents, improves the directional control, limits the amount of product to reduce the tendency to overspray, stores with the aerosol can, and seals the nozzle.

The Invention

SUMMARY OF THE INVENTION, INCLUDING OBJECTS AND ADVANTAGES

The invention is directed to a spray delivery system for pressurized aerosol cans comprising an improved aerosol can button having a short connector or union dispensing tube, an extension tube, and extension tube keeper system for storage of the extension tube on the can after use, a spray volume limiter, and a seal cap that fits over either the outer end of the button connector tube or the extension tube outer end. The system is further preferably provided in a kit form either by the OEM producer of the aerosol product along with the new can, or as an after-market product.

As shown in more detail below, a number of equivalent variations in the system may be employed. In its present preferred, best mode form, the short connector is permanently secured in a recess in the side wall of the improved aerosol can button, molded into or glued into the button as an integral part thereof, and extends on the order of ¼–2"" (more preferably ⅜" to 1") outwardly from the cylindrical surface of the button. Actuating the valve button opens the product passage between the dip tube, through the valve button and the central bore of the connector. It is preferred that the connector does not extend beyond the side edge of the can and is short enough to provide adequate clearance to be covered by the conventional can cap. Certain products, like WD-40 that come with small, 1" diameter steel or plastic caps that engage the valve element shoulder at the rolled inner edge of the can dome, may need to employ larger, conventional plastic caps that engage the outer shoulder of the aerosol can in order to have a connector of adequate length to engage the extension tube.

The present preferred design of the extension tube has a first flared outer end to fit over the short connector so that the extension tube is securely retained on the connector. The flare can be molded into the extension tube or extension straw, or a section of larger tube can be slipped over both the extension tube and the connector, much as a sleeve or collar. In this embodiment, the collar can be mounted (glued) to either the connector or the extension tube, preferably the latter. The connector tube is sized for diameter and length to receivingly engage the extension tube for confined delivery of a controlled amount of product spray to a user-desired target. The extension tube can be any pre-selected length, typically on the order of 6"–12". In addition the kit can contain a plurality of extension straws of varying length, say three straws of length 6", 12" and 18" for a variety of delivery applications in hard to reach locations.

The keeper system comprises a thin-walled retainer tube secured by an adhesive-backed strip of tape to the side of the can. The retainer tube is short, on the order of 1" to 2" in length and has an inner diameter larger than the exterior diameter of the extension tube. The tape radially compresses the retainer tube sufficiently that at that point of compression the retainer tube is deformed in cross-section to oval and has a minor axis of length enough smaller than the outer diameter of the extension tube as to grip the extension tube when inserted into the retainer tube.

The spray discharge volume limiter comprises a thin but strong metal or plastic tab that is C-shaped or U-shaped in plan view, and is inserted between the top rolled inner edge of the can dome and the bottom of the button. The gap between the arms of the C or U permits the limiter tab to clear the valve stem extending up from the can, but the gap is slightly smaller than the outer dimension of the valve stem to prevent the limited tab from falling off the can during use. The limiter tab is flexible so that it easily "snaps" over the valve stem. In addition the arms are long enough to bridge the entire valve assembly, that is reach from side to side of the rolled inner edge of the can dome. Upon pressing down on the button, the valve can only be partly opened, thus limiting the rate and volume of the discharge of product. Where the limiter has flexibility, increased downward pressure permits proportional control of the rate and volume of the contents discharge.

The seal cap element is sized to snugly fit over and be secured on either the outer end of the connector stem or the outer end of the extension tube. Note that the extension tube is the same exterior diameter as the connector by virtue of the flare or the sleeve/collar so that the cap fits both. This dual functionality of the cap is the preferred embodiment, but where the sleeve is secured to the connector, a second, larger cap can additionally be provided as a closure to that sleeve.

BRIEF DESCRIPTION OF THE DRAWINGS

The invention is described in more detail with reference to the drawings, in which:

FIGS. 7 through 9 show the limiter shim portion of the inventive system, in which FIG. 8 is an isometric showing the shim inserted around the outlet valve stem, bridging the inner rim; and FIG. 9 is a side elevation view showing the limited discharge provided by the use of the shim limiter.

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly stated to be incorporated by reference.

Figure 1:
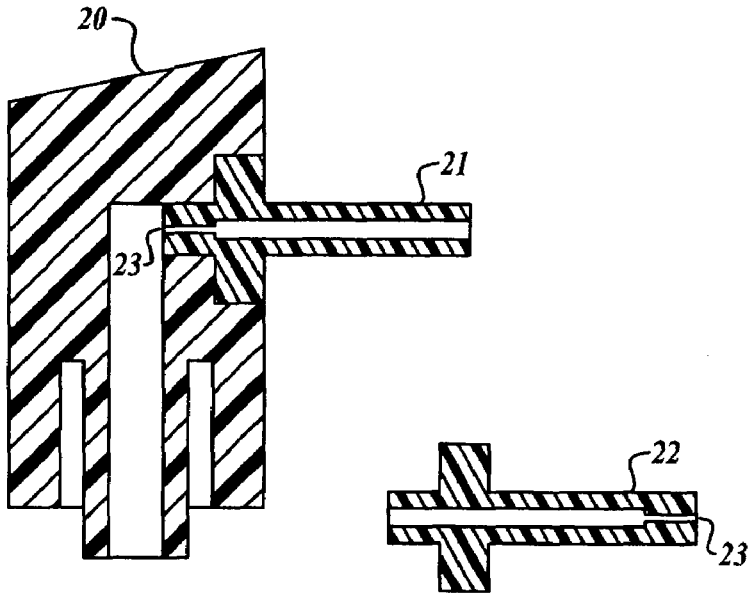
FIG. 1 is a vertical section view through a button of the inventive system, showing the short, male button with connector tube in two forms, one with the metering orifice internal to the button, and the second with the metering orifice at the external tip of the connector.
Figure 2:
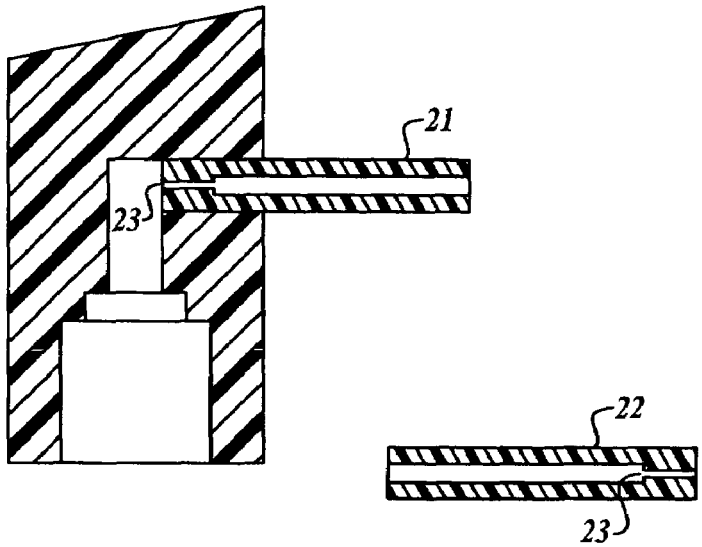
FIG. 2 is a vertical section view through a button of the inventive system, showing the short female button with the same two forms of connector tube as FIG. 1.

FIGS. 1 and 2 are section views of typical male and female valve buttons 20, respectively, having two basic variations of short connector tubes 21, 22 press fit or glued in place, recessed in the sidewall of the spray valve button. Each connector tube having a central bore, a first, inner end permanently secured in a recessed call in the valve button, and a second outer end that extends outward from the button. Note the distinction between the variations 21 and 22 is the placement of the volume-restricting, lateral metering orifice 23 either internal to the valve button in variation 21 (adjacent the intersection of the vertical product delivery duct that connects to the valve stem 40, see FIG. 6A) or at the external end of the connector in variation 22.

Figure 3:
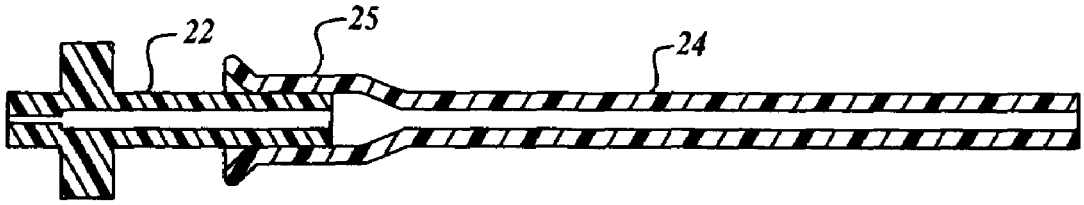
FIG. 3 is a section view through the long extender tube showing the first flared end that fits over the connector tube and the second outer end extending out.

FIG. 3 shows the long extension tube 24 having a belled and flared end 25 to fit over the connector.

Figure 4:
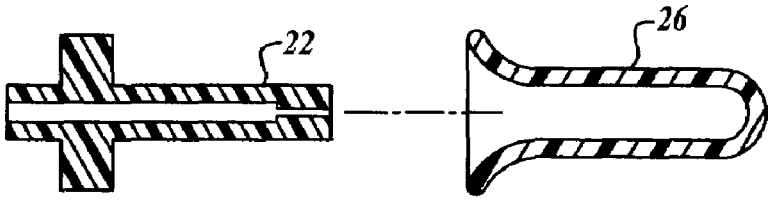
FIG. 4 is a section view showing closure seal cap and how it fits over the outer end of the connector tube.

FIG. 4 shows the use of cap 26 as a closure for either the connector 21, 22 or the extension tube 24.

Figure 5A:
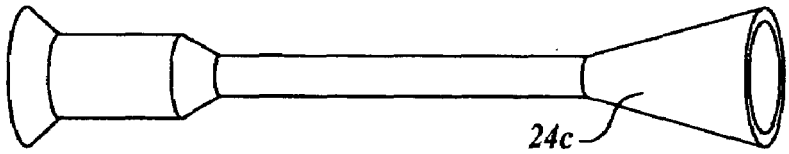
FIG. 5A is the isometric view of fan-shaped tip extension tube 24*c.
Figure 5B:
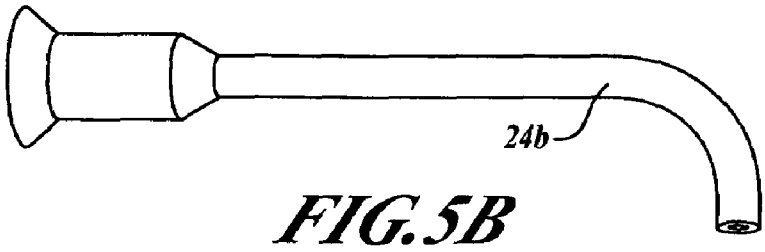
* FIG. 5B is the isometric view of the curved extension tube 24*b*.

FIGS. 5*a* and 5*b* show in isometric views the fan-tipped 24*c* and curved 24*b* extension tubes, respectively. Both have a flared opposite end 25 to slip over the connector 21 or 22.

Figure 6A:
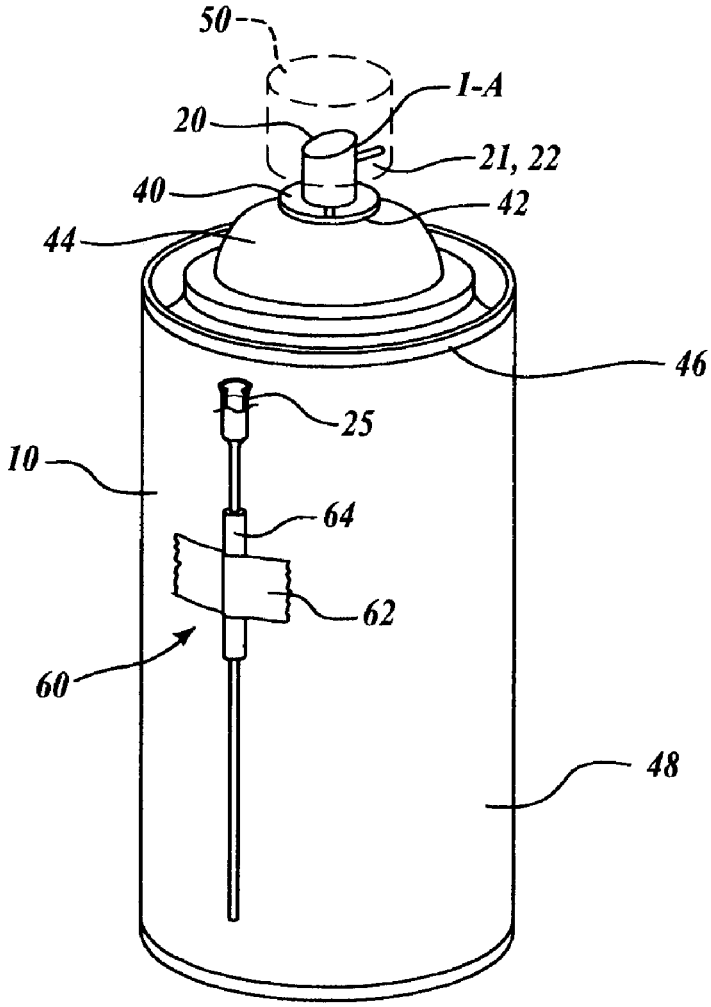
FIG. 6A is an isometric view of an aerosol can having the inventive system applied thereto, including the inventive spray valve button with the short connector in place over the dip tube of the outlet valve stem and the keeper system comprising the retainer tube taped to the side of the can and having the extension tube inserted in and retained by the retainer tube.
Figure 10:
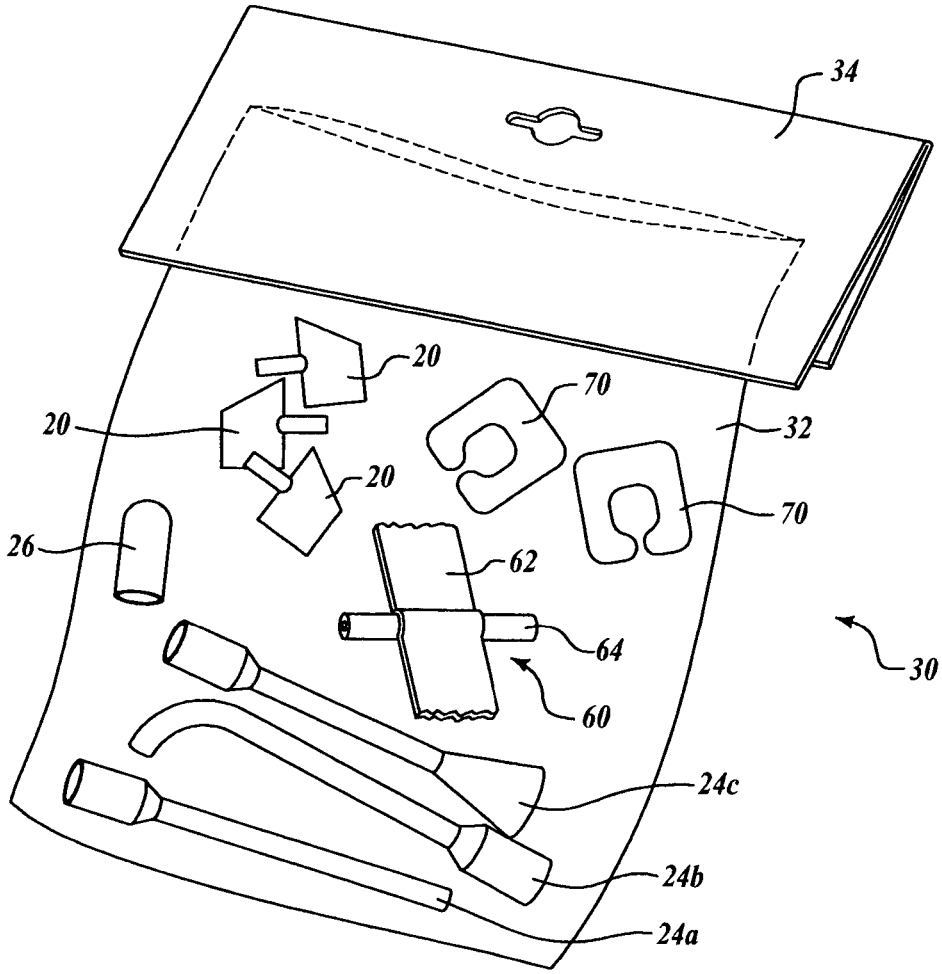
FIG. 10 is a schematic isometric of the kit aspect of the inventive aerosol product dispenser system.

Comparing FIGS. 6A and 10, the consumer can receive the inventive system in several ways. FIG. 6A shows and OEM product aerosol can 10 on which the inventive button 20 mounted on its generally planar top cap, and having a short connector tube 21 or 22 is fitted on the valve stem 40 of the product release valve assembly. An over-cap 50 is typically provided. In addition, a keeper system 60 is provided on the side of the can, and comprises tape 62 securing a radially compressible retainer tube 64 which receives and retains the extension tube 24, oriented with the flared and belled end 25 upward. The optional cap 26, not shown, may be included on either the short connector, type 21 or 22, or the long extension tube 24.

Figure 6B:
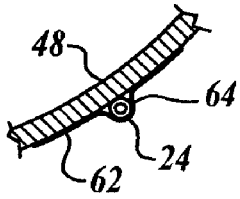
FIG. 6B is a section view through the keeper system as applied to the aerosol can showing the compression of the retainer tube to retain the extension tube.

FIG. 6B shows the tape 62 of the keeper system 60 applied to the side of the can 48, with the pressure of the tape flexing the retainer tube 64 into an oval cross section so that it grips the inserted extension tube 24 thereby retaining it in place.

Figure 7A:
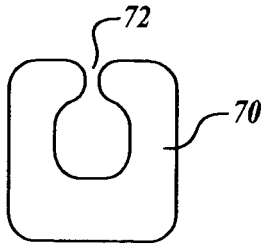
FIG. 7*a* is a section view of the shim.
Figure 7B:
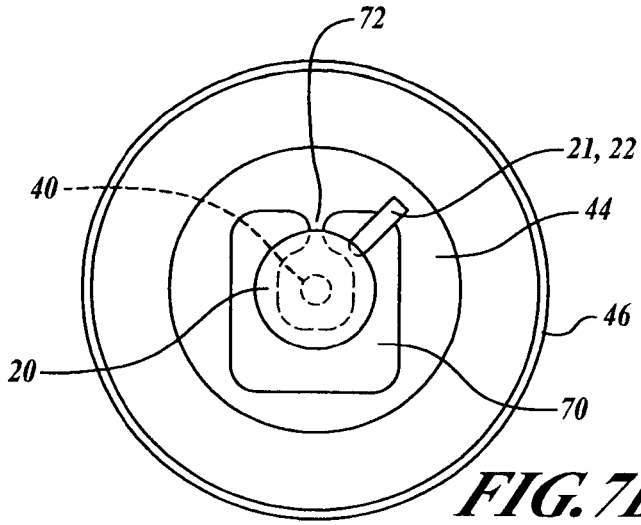
FIG. 7*b* is a plan view from the top.
Figure 8:
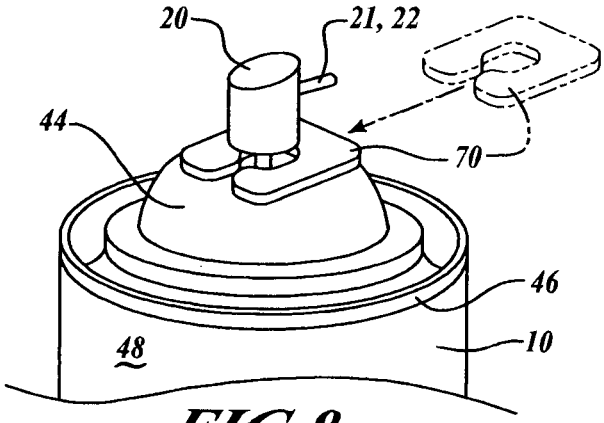
Figure 9:
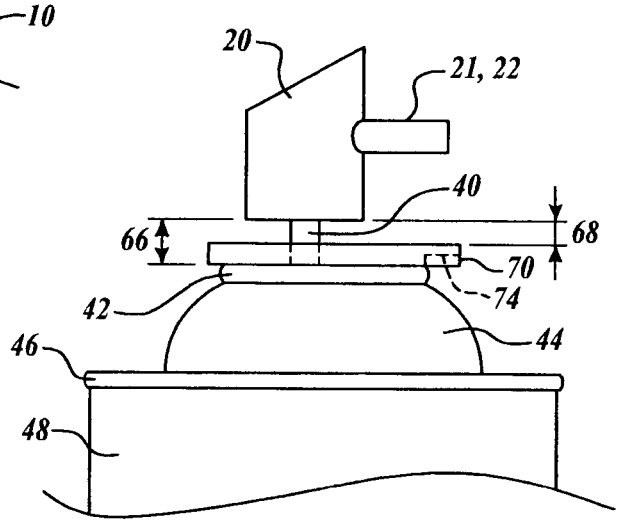

FIGS. 7–9 (and referring also to FIG. 6A) show the use of the limiter shim 70 to limit the vertical motion of the button when it is pressed down to release product from the can 10. The limiter shim can have a range of pre-selected thicknesses to offer a range of product flow controls, depending on the type of product in the can, typically from 1/32" thick to 1/8" thick. The shim is generally C-shaped or U-shaped in section view as shown in FIG. 7*a,* having a suitable gap 72 to provide clearance for the valve stem 40. The gap 72 is just slightly smaller than the diameter of valve stem 40 to prevent the shim from falling off during use, but its flexibility allows it to "snap" over the valve stem 40. The width and length of the shim is large enough to bridge the inner rim 42 of the can 10, and provide enough overhang 74 (FIG. 10) on one side so it can be easily inserted and removed. FIG. 7*b,* the plan view from above, shows how the limiter shim 70 slips around valve stem 40 and under button 20. As best seen in FIG. 9, the shim, in place limits the downward motion of the button so there is a lower volume or rate of discharge. The vertical discharge distance is cut down by the shim by any pre-selected amount depending on the thickness of the shim. The can dome is 44, the outer dome rim is 46 and the vertical can wall is 48 in FIGS. 6A, 8 and 9.

FIG. 10 shows in isometric an after-market kit 30 comprising a plastic bag 32, having an optional header card 34, in which is contained 1 or more valve buttons 20 each having an appropriate connector tube 21 or 22, the male or female valve buttons of different sizes being selected to fit on the valve stems of most of the popular types of aerosol can products in distribution. In addition 1 or more, preferably three, types of extension tubes 24*a*–24*c* are provided. Extender 24*a* is straight, 24*b* is curved and 24*c* has a fan or slot tip. Also included in the kit is a keeper system 60, in which case the tape 62 includes a release strip on the back side to protect the adhesive of the tape. The kit also may include the cap 26 and one or more limiter shims 70.

INDUSTRIAL APPLICABILITY

It is clear that the inventive aerosol product dispenser system of this application has wide applicability to the aerosol can filling industry, namely for lubricants, paints, herbicides, insecticides, personal care products, and the like.

It should be understood that various modifications within the scope of this invention can be made by one of ordinary skill in the art without departing from the spirit thereof and without undue experimentation. For example, the extender tubes can have a wide range of lengths, from 3" to 18" or more, and delivery tip designs to provide the functionalities disclosed herein.

This invention is therefore to be defined by the scope of the appended claims as broadly as the prior art will permit, and in view of the specification if need be, including a full range of current and future equivalents thereof.

The invention claimed is:

1. In an aerosol can spray delivery system of the standard type having a two-part spray button comprising:

a pressurized aerosol can having a generally planar top cap in which is mounted a product release valve assembly, said top cap being secured to a top dome of said can at a rolled inner edge of said dome, said valve communicating internal of the can with a dip tube and communicating at an outlet end with a standard two-part finger-actuatable spray button of the type including a product passage therein in communication with the outlet end of said valve, and a small diameter lateral metering orifice disposed recessed in a lateral bore in the sidewall of said button, said metering orifice communicating with said button product passage but does not extend beyond the sidewall of said button.

the improvement in said aerosol can spray delivery system comprising replacement of said standard two-part spray button with an improved button comprising:

a) a spray button selected from a male button and a female button having a lateral bore communicating with a vertical central product passage bore;

b) a short connector tube having a central bore and a first, inner end permanently secured in said lateral bore of said spray button in place of said standard button metering orifice, said connector tube terminates in an outer, second end and said connector tube includes a restriction disposed at one end therein defining a spray metering orifice;

c) said bore of said connector tube is in communication with said button product passage;

d) said connector tube has a length in the range of from about 1/4" to about 2";

e) an extension tube straw having a first, belled and flared end and a second outer end, said first belled and flared end is sized to receivingly engage and be securely retained on said connector tube outer end to provide remote, targeted delivery of product spray, produced from said connector tube, to and from the outer end of said extension tube without overspray, and said second outer end of said extension tube straw does not have a restricted orifice therein; and f) so that said connector tube is secured in said spray button lateral bore with its central bore opening and metering orifice coordinated with the button product passage to provide continuous flow of product from the can through the connector tube when the button is actuated to produce spray, said connector tube being sized for diameter and length to receivingly engage said extension tube straw for confined delivery of a controlled amount of product spray produced by said connector tube to a user-desired target without overspray.

2. An improved aerosol can spray delivery system as in claim 1 which includes a removable cap that sealingly fits over said connector tube outer end and said extension tube outer end to seal the tubes when not in use.

3. An improved aerosol can spray delivery system as in claim 1 which includes an extension tube keeper system comprising a radially compressible, thin-walled retainer tube open at both ends, said retainer tube is sized to receive said extension tube, secured to an adhesive-backed strip that is affixable to an outer wall of said can, said thin retainer tube walls being compressible to deform said tube from circular in cross section to oval in cross section when secured to said outer wall of said can by said adhesive strip so that the minor axis of said oval is less than the outer diameter of said extension tube to permit gripping said extension tube for storage in said retainer tube by virtue of its compression to an oval cross-section, when said extension tube is not attached to the connector.

4. An improved aerosol spray delivery system as in claim 1 wherein said extension tube includes an outer end region selected from straight, fan-shaped and curved to accommodate targeted delivery of a selected shape of product spray to a variety of surfaces.

5. An improved aerosol spray delivery system as in claim 1 which includes a spray volume limiter comprising at least one generally C-shaped shim that is removably introduced between a bottom end of said button and said dome top rolled edge, said shim having arms defining a C-shaped opening that provides a gap slightly less than the diameter of an aerosol can valve or button stem to prevent said limiter shim from falling off said stem, said limiter shim having a flexibility that allows said limiter shim to snap over the stem, said limiter shim arms are wide and long enough to bridge the entire valve assembly from side to side of said rolled inner edge of said dome, and said shim is thinner than the distance between said bottom of the button and said dome top rolled edge to permit a predetermined, limited amount of vertical movement of the button thereby controlling the volume of product flow through said valve when said button is actuated and reducing overspray.

6. An improved aerosol spray delivery system as in claim 5 which said limiter shims are of selectively different thicknesses or have flexibility to offer a range of product flow controls.

7. An improved aerosol spray delivery system as in claim 1 wherein the length of the extension tube is in the range of from about 6" to about 18".

8. An improved valve button for an aerosol can spray delivery system as in claim 1 wherein said connector tubes range in length from about ⅜" to about 1".

9. An accessory kit for an aerosol can spray delivery system comprising:

a) at least one improved replacement actuator spray button of claim 1 that is permanently fitted with a short connector tube of length from about ¼" to about 2" with a metered orifice at one end of said connector tube to produce product in spray form;

b) at least one extension tube straw that is belled and flared at a first, inner end to receivingly engage and be securely retained by said connector tube, and that does not have at a second, outer end a restricted orifice therein and which conveys the product spray produced in said connector tube to a target with reduction in overspray;

c) a sealing tip cap;

d) at least one C-shaped spray volume limiter shim insertable between the bottom of said actuator spray button and a rolled edge of an aerosol can, said limiter shim having arms defining a C-shaped opening that provides a gap slightly less than the diameter of an aerosol can valve or button stem to prevent said limiter shim from falling off said stem, said limiter shim having a flexibility that allows said limiter shim to snap over the stem, said limiter shim arms are wide and long enough to bridges the entire valve assembly from side to side of said rolled inner edge of said dome, and said limiter shim is thinner than the distance between said bottom of the button and said dome top rolled edge to permit a predetermined, limited amount of vertical movement of the button thereby controlling the volume of product flow through said valve when said button is actuated and reducing overspray; and e) a thin-walled, radially deformable tube having both ends open as an extension tube keeper system to attach to the wall of said can.

10. An accessory kit for an aerosol can spray delivery system as in claim 9 which includes two or more:

a) buttons, including at least one male and one female button;

b) extension tubes of different shapes, including: straight, fan-tipped and curved; or c) limiter shims of different thicknesses or have flexibility.

11. An accessory kit for an aerosol can spray delivery system as in claim 10 wherein said extension tubes range in length from about 6" to about 18".

12. An accessory kit for an aerosol can spray delivery system as in claim 10 wherein said limiter shims range in thickness from about 1/32" to about ⅛".

13. An accessory kit for an aerosol can spray delivery system as in claim 9 wherein said connector tubes range in length from about ⅜" to about 1".

* * * * *